United States Patent [19]

Keating

[11] Patent Number: 4,621,310

[45] Date of Patent: Nov. 4, 1986

[54] HEATING LUMINAIRE PROTECTOR

[76] Inventor: Richard Keating, 330 Sutton Rd., Barrington Hills, Ill. 60010

[21] Appl. No.: 756,166

[22] Filed: Jul. 18, 1985

[51] Int. Cl.[4] ..... F21V 7/00

[52] U.S. Cl. ..... 362/344; 362/376; 99/450; 219/348

[58] Field of Search ..... 362/344, 376, 377, 378; 237/77, 79

[56] References Cited

U.S. PATENT DOCUMENTS

| | | | |
|---|---|---|---|
| 129,362 | 7/1872 | Page | 99/450 |
| 509,916 | 12/1893 | Leslie | 126/9 B |
| 776,633 | 12/1904 | Winbolt | 362/376 |
| 1,205,011 | 11/1916 | Phillips | 362/376 |
| 1,287,298 | 12/1918 | Halvorson | 362/376 |
| 1,305,130 | 5/1919 | Ledig | 219/347 |
| 1,320,902 | 11/1919 | Newton | 362/376 |
| 1,444,054 | 2/1923 | Benjamin | 362/376 |
| 1,750,870 | 3/1930 | Vooth | 362/376 |
| 1,923,970 | 8/1933 | Dowling | 362/376 |
| 2,419,357 | 4/1947 | Krasner et al. | 126/9 B |
| 2,421,057 | 5/1947 | Dunkelberger | 362/376 |
| 2,610,285 | 9/1952 | Rusnak et al. | 362/378 |
| 2,631,216 | 3/1953 | Ames | 219/348 |
| 2,681,061 | 6/1954 | Modell | 219/339 |
| 3,033,982 | 5/1962 | Burns | 362/376 |
| 3,300,637 | 1/1967 | Martland | 362/377 |
| 3,586,823 | 6/1971 | Schier | 219/347 |
| 3,713,453 | 1/1973 | Chiaro et al. | 219/347 |

*Primary Examiner*—E. Rollins Cross

*Attorney, Agent, or Firm*—Nicholas A. Camasto

[57] ABSTRACT

A heating luminaire has a slightly resilient spun metal housing with a rolled bead of larger diameter formed near the circular opening thereof. A wire guard having four extensions arranged to seat within the bead is inserted through the circular opening, which is of smaller diameter than the bead, by bending one of the extensions and distorting the resilient housing. The guard is locked in place by bending the extension back toward its original position.

5 Claims, 6 Drawing Figures

HEATING LUMINAIRE PROTECTOR

BACKGROUND OF THE INVENTION AND PRIOR ART

This invention relates generally to luminaries and particularly to a low cost guard for an infrared food warmer luminaire.

The fragile nature of the glass envelopes used for lightbulbs and heating lamps and the like has led to the development of many types of protection devices. The protection devices, generally referred to as guards, in addition to safeguarding the glass envelope, also provide protection against objects or people being burned by contact with the very hot surface of the lamp. In particular, some protection devices also serve as reflectors for helping to direct the radiant energy emitted from the lamp to a particular area. Most lamps are used primarily for illumination and many are mounted in hard to reach areas. The prior art includes many types of protection devices to protect the bulb from damage from objects and flying missiles. Each usually incorporates a screen of sufficiently large mesh to allow substantially unimpeded light or heat transmission, yet of small enough dimensions to preclude entry of most foreign objects. Since bulbs need replacement on occasion, many mechanisms for facilitating removal of all or a portion of the protection device to permit relatively easy access to the lamp have been used. Most such protection devices have either a spring-loaded shield that covers the open end of the reflector housing or a shade arrangement to maintain the protection device in position by means of a ring that is compressed by a nut and bolt closure. Such devices are of complex construction and therefore costly to implement. The present invention is directed to a low cost luminaire guard arrangement.

In the food service industry, infrared heating lamps are used to maintain cooked foods in a warmed condition. These heat lamps are operated just above table height and are therefore readily accessible. This ready accessibility exposes the bulbs to breakage and creates a serious problem in the kitchen or cooking environment because of the possibility of getting broken glass fragments in the food. Thus, breakage of a bulb and the consequent shattering of the glass could have dire consequences. It will also be appreciated that because the heat lamps are located at working level and subject to being bumped or jostled, conventional spring loaded devices for retaining a bulb protector in place may be unsuitable for keeping the protector securely mounted to the reflector housing or shell. While many of the devices of the prior art would provide such a secure mounting, most are either too expensive or cumbersome. Consequently, there is a need in the art for a simple mechanism for providing protection for a heating lamp bulb in a reflector shell for use in maintaining food at a proper temperature.

OBJECTS OF THE INVENTION

A principal object of the invention is to provide a novel food warmer device.

Another object of the invention is to provide a food warmer lamp device with a simple protective element for protecting the lamp.

Another object of the invention is to provide a simple low cost protective grill for a food warmer lamp.

BRIEF DESCRIPTION OF THE DRAWINGS

These and other objects of the invention will be apparent upon reading the following description in conjunction with the drawings in which.

DESCRIPTION OF THE PREFERRED EMBODIMENT

Figure 1:
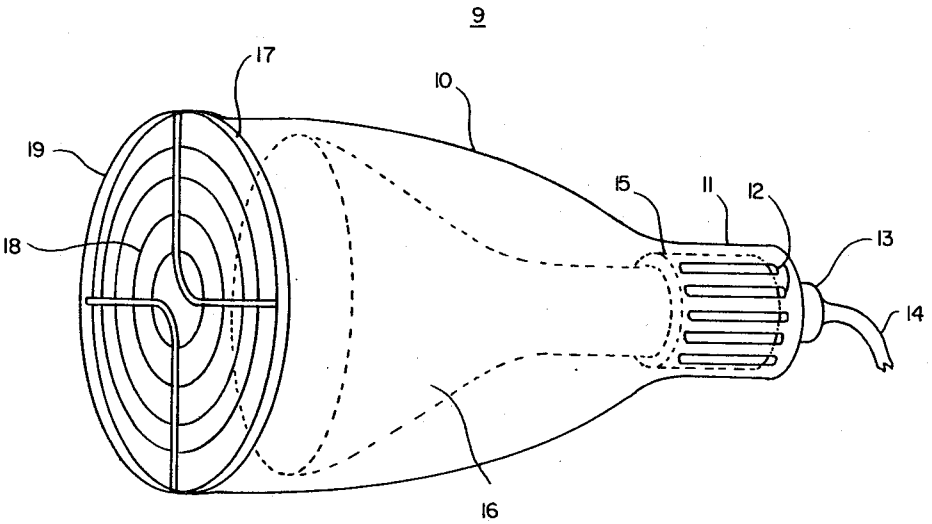
FIG. 1 is a perspective view of a luminaire constructed in accordance with the invention.

Referring to FIG. 1, a luminaire generally comprises a spun metal housing 10 of a conical or tulip-like configuration, adapted to substantially enclose an infrared lamp bulb 16 supported therein. Housing 10 includes a smaller diameter cylindrical neck portion 11 that includes a plurality of slot-like vents 12 formed therein for ventilation purposes and an electrical lamp recepticle 15 for receiving lamp bulb 16. Recepticle 15 is connected to a conventional lamp cord 14 coupled thereto by means of an insulated grommet mounted in a hole in the rear of housing 10. Receptacle 15 and bulb 16 are shown in dashed lines. Bulb 16 is of the infrared heating type. The large open end of housing 10 forms a circular edge 19 which defines a circular opening. An outwardly disposed rolled bead 17 is formed adjacent to edge 19. Thus the diameter of rolled bead 17 is greater than the diameter of edge 19. Rolled bead 17 provides a recess for nesting of a lamp guard 18 in the open end of housing 10 for protecting bulb 16.

Figure 2:
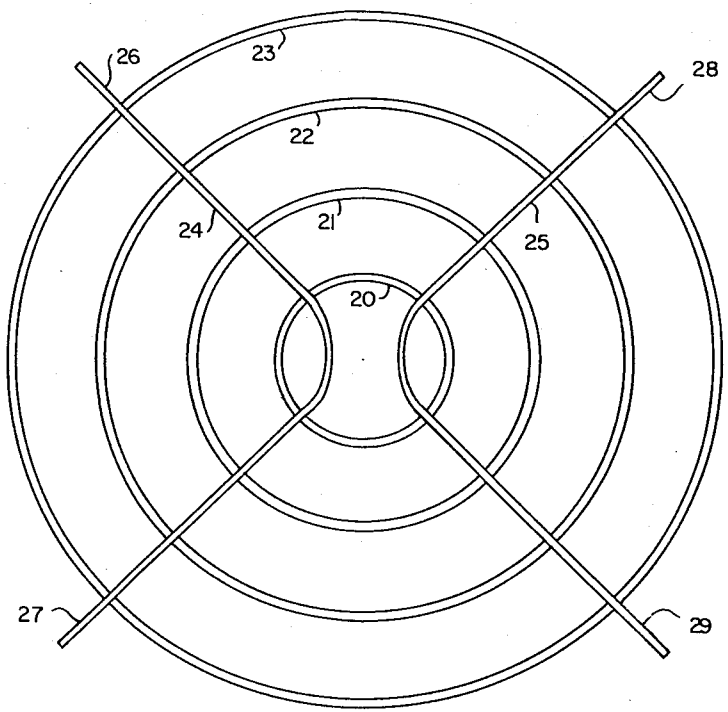
FIG. 2 is a plan view of the protective guard used with the luminaire of FIG. 1.

FIG. 2 shows a plan view of lamp guard 18. In its preferred form, lamp guard 18 comprises a plurality of metallic annular rings 20–23 of increasing diameter that are welded to a pair of right angle cross members 24 and 25. Cross member 24 has short extensions 26 and 27 that extend beyond outer annular ring 23 and cross member 25 similarly has short extensions 28 and 29 extending beyond ring 23. While the specific dimensions of the guard will be recognized as being a matter of choice, the distance spanned by the tips of the extensions, and the diameters of circular edge 19 and rolled bead 17 are important aspects of the invention. For the guard illustrated, the annular rings have diameters of $1\frac{1}{4}''$, $2\frac{1}{2}''$, $3\frac{7}{8}''$ and $5\frac{3}{8}''$, respectively, the outer distance between the tips of extensions 26 and 29 and between the tips of extensions 27 and 28 is 6-7/16" and the guard is constructed of 1/16" diameter wire. In the preferred embodiment the guard is rigid. In another embodiment, the guard may be constructed to have a small amount of resilience to facilitate installation in housing 10. In a still further embodiment, the housing is sufficiently resilient to enable positioning of the guard in the recess means formed by the rolled bead.

Figure 5:
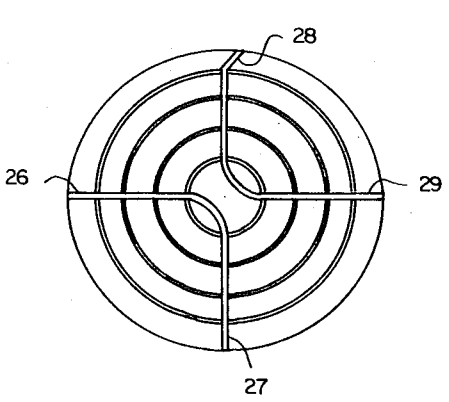
FIGS. 3, 4 and 5 are partial views illustrating methods of mounting the protective guard to the luminaire housing in accordance with different aspects of the invention.
Figure 4:
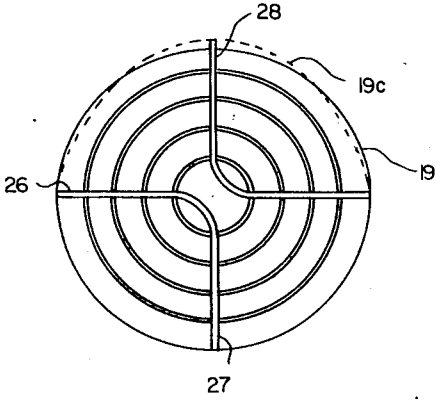
Figure 3:
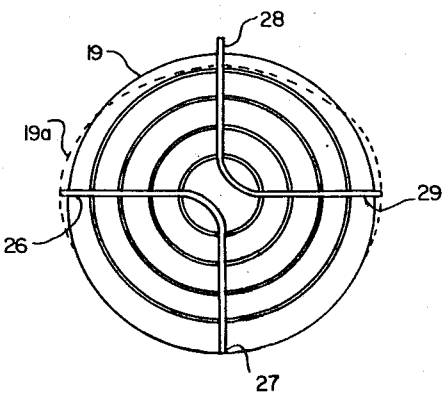

FIGS. 3, 4 and 5 illustrate methods of assembling the guard in the rolled bead 17 formed at the edge of housing 10. It should be understood that the rolled bead on housing 10 has as diameter that is about 1/16" larger than the diameter of circular edge 19 To clarify the illustration, rolled bead 17 is omitted in these figures. Rather, circular edge 19, which has a smaller diameter than bead 17, is used to explain installation of the guard in the housing. Thus, it should be borne in mind that guard 18 is actually retained in housing 10 by the tips of extensions 26–29 resting in rolled bead 17. Since the tips must clear the circular edge 19 that has a smaller diameter than that of rolled bead 17 in order to "seat" guard 18 in housing 10, either the tips must be deflectable or the edge of housing 10 must be deformable.

In FIG. 3, circular edge 19 is illustrated by a dashed line and circular edge 19*a* is illustrated by a solid line. The dashed line edge 19*a* is the result of deflection of shade 10 due to pressure being applied at appropriate portions of its periphery to enable the tips of extensions 26 and 29 to pass through the distorted opening of circular edge 19 and engage rolled bead 17. Thus, by distortion into a partial elliptical shape, selected dimensions of the housing are increased to enable extensions 26, 27 and 29 to be seated. As shown in FIG. 4, a further distortion of housing 10, with the tips of extension 26, 27 and 29 of the guard seated in rolled bead 17, is made to enable the tip of extension 28 to be positioned within the housing. Thus the overall dimensions of the extensions from tip to tip are such that the guard just fits within the inner circumference of rolled bead 17 in housing 10. The guard is maintained in position by the resilience of housing 10. Alternatively, the extensions, or one extension, may be made resilient to allow it to be temporarily bent to clear circular edge 19, FIG. 5, illustrates the preferred technique for firmly seating guard 18 in housing 10. Three of the extension tips are inserted as above, that is, by deformation of housing 10. However, the fourth extension 28 is physically bent at an angle of approximately 45 degrees to enable it to pass through the opening defined by circular edge 19 and be positioned within the rolled bead. When the guard is in position in the bead, the physically bent extension 28 is bent back toward its original shape to lock the guard in position in the housing. Bending may be readily accomplished with a tool, such as a conventional set of pliers. It will be appreciated that this latter technique for positioning the guard in the housing effectively precludes the guard from being accidently dislodged from the housing and provides a simple positive lock in the rolled bead. Removal of the guard for replacement of the bulb, should the need arise, is readily accomplished by reversal of the above procedure.

Figure 6:
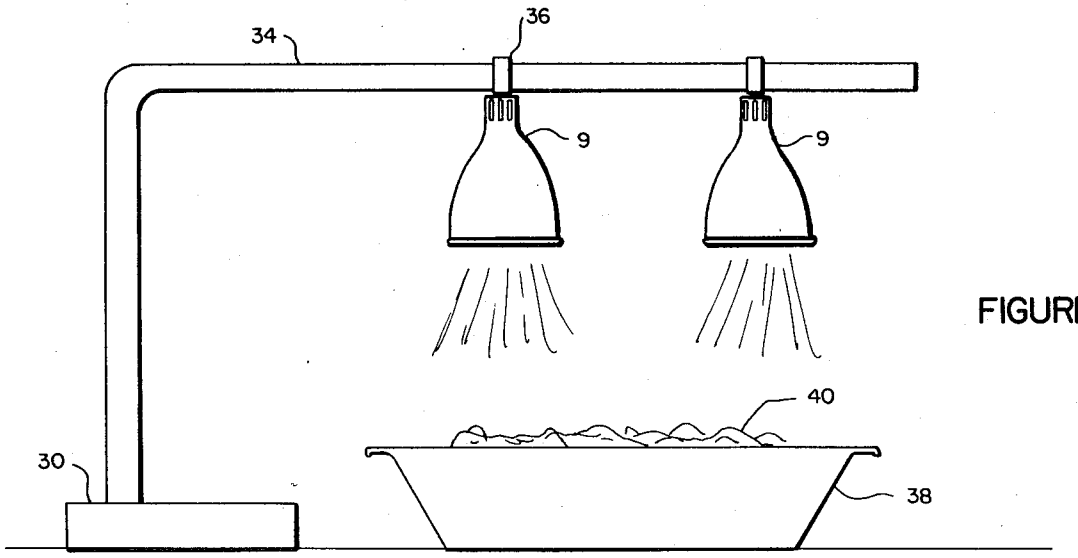
FIG. 6 is a food warming station having a pair of food warmer lamps in luminaires constructed in accordance with the invention.

FIG. 6 illustrates a food warming station that may typically be found in a restaurant cooking area. A base 30 supports a generally "L"-shaped support comprising an upright section 32 and a horizontal arm section 34, from which a pair of luminaires 9, constructed in accordance with the invention, are supported. A suitable clamp mechanism 36 is used to support the luminaires in position over a tray 38 containing cooked food 40 to be kept warm. Obviously, a greater number of luminaires may be used as desired. While the design of the station may provide for differing distances between the luminaire and the food, the proximity of the fragile bulb to the food creates the need for the inventive guard.

What has been described is a novel guard arrangement for a food warmer lamp which is economical to manufacture and positive in operation. It is recognized that numerous changes and modifications in the described embodiment of the invention will be apparent to those skilled in the art without departing from its true spirit and scope. The invention is to be limited only as defined in the claims.

What is claimed is:

1. A luminaire comprising:

a generally conical metal housing defining a circular opening for insertion and removal of a bulb;

recess means adjacent said circular opening defining an annular ring of greater diameter than the diameter of said opening;

protective guard means for covering said opening;

rigid extension means on said protective guard means, when in an undeformed condition, defining a circle of substantially the same diameter as the diameter of said recess means;

said housing being slightly deformable under pressure to enable said rigid extension means, when in a deformed condition, to be manipulated through said circular opening and into position in said annular ring; and means for locking said protective guard means into said recess means by use of a tool to at least partially restore said rigid extension means to said undeformed condition.

2. The luminaire of claim 1 wherein said metal housing comprises a metal shell, said protective guard means comprise wire and wherein said recess means comprises a rolled bead formed in said shell near said circular opening; and wherein said extension means are bendable by means of said tool to enable positioning and locking thereof in said bead.

3. The luminaire of claim 2 wherein said extension means are fabricated of rigid wire and wherein said tool is a pair of pliers.

4. A heating luminaire comprising:

a generally conical spun metal housing defining a circular opening for insertion and removal of a heat bulb;

a rolled bead of larger diameter than said circular opening formed in said metal housing adjacent to said circular opening;

a protective lamp guard fabricated of rigid wire for covering said opening and protecting said bulb;

wire extensions on said lamp guard having tips, which when in an undeformed condition, lie in a circle of a diameter slightly greater than the diameter of said circular opening and slightly less than the diameter of said rolled bead;

said metal housing being deformable to enable said protective lamp guard to be manipulated through said circular opening and into position in said rolled bead when one of said wire extensions is in a deformed condition; and tool means for bending said one extension partially back to said undeformed condition to thereby lock said protective lamp guard in position in said rolled bead.

5. A food warmer comprising an overhanging arm for supporting one or more heat warming luminaires adjacent a supply of food to be warmed;

each said luminaire including a slightly deformable spun metal housing of generally conical configuration for encircling a heat bulb and having a generally circular edge defining a circular opening for insertion and removal of said bulb;

a rolled bead, of larger diameter than said circular opening, formed in said spun metal housing adjacent to said circular opening;

a lamp protector in each said spun metal housing comprising a wire guard having extensions, which when in an undeformed condition, lie in a circle of diameter greater than the diameter of said circular opening and less than the diameter of said rolled bead;

means for temporarily bending one of said extensions with a tool or the like such that by slight deformation of said housing said guard may be inserted through said circular opening into position with said extensions resting in said rolled bead; and means for at least partially removing, with a tool, the bend in said one of said extensions to lock said guard into position in said rolled bead.

* * * * *